US005878725A

United States Patent [19]

Osterbrink

[11] Patent Number: 5,878,725

[45] Date of Patent: Mar. 9, 1999

[54] CANISTER VENT/PURGE VALVE

[75] Inventor: Mark D. Osterbrink, St. Clair Shores, Mich.

[73] Assignee: Borg-Warner Automotive, Inc., Sterling Heights, Mich.

[21] Appl. No.: 946,624

[22] Filed: Oct. 7, 1997

[51] Int. Cl.[6] ..... F02M 33/04

[52] U.S. Cl. ..... 123/516; 123/519; 251/30.01; 137/588

[58] Field of Search ..... 123/516, 518, 123/519, 520; 137/588; 251/30.01

[56] References Cited

U.S. PATENT DOCUMENTS

| | | | |
|---|---|---|---|
| 4,953,514 | 9/1990 | Beicht et al. . | |
| 5,117,797 | 6/1992 | Telep et al. | 123/520 |
| 5,183,022 | 2/1993 | Cook | 123/516 |
| 5,199,404 | 4/1993 | Cook et al. . | |
| 5,211,151 | 5/1993 | Nakajima et al. | 123/516 |
| 5,277,167 | 1/1994 | DeLand et al. . | |
| 5,289,811 | 3/1994 | Covert et al. . | |
| 5,411,004 | 5/1995 | Busato et al. . | |
| 5,417,402 | 5/1995 | Speybroeck | 251/30.01 |
| 5,429,099 | 7/1995 | DeLand . | |
| 5,437,257 | 8/1995 | Giacomazzi et al. . | |
| 5,450,833 | 9/1995 | Denz et al. . | |
| 5,460,141 | 10/1995 | Denz et al. . | |
| 5,467,960 | 11/1995 | Morris et al. | 251/30.01 |
| 5,469,886 | 11/1995 | Noya . | |
| 5,479,904 | 1/1996 | Fujimori et al. . | |
| 5,499,614 | 3/1996 | Busato et al. . | |
| 5,542,397 | 8/1996 | Takahata et al. . | |
| 5,551,406 | 9/1996 | Everingham et al. . | |
| 5,560,347 | 10/1996 | Reddy et al. . | |
| 5,562,084 | 10/1996 | Shimamura . | |
| 5,562,757 | 10/1996 | Brun et al. . | |
| 5,609,135 | 3/1997 | Ogawa et al. . | |
| 5,613,477 | 3/1997 | Maeda . | |
| 5,614,665 | 3/1997 | Curran et al. . | |
| 5,623,911 | 4/1997 | Kiyomiya et al. . | |
| 5,629,477 | 5/1997 | Ito . | |
| 5,630,403 | 5/1997 | Van Kampen et al. . | |
| 5,632,251 | 5/1997 | Ishikawa | 123/519 |
| 5,635,630 | 6/1997 | Dawson et al. . | |

*Primary Examiner*—Thomas N. Moulis
*Attorney, Agent, or Firm*—Reising, Ethington, Learman & McCulloch PLLC; Greg Dziegielewski

[57] ABSTRACT

A combination vent valve/purge valve apparatus (10) for an automotive fuel vapor recovery system canister (14) comprises a purge valve (26) and a vent valve (16) in a single housing. When open, the vent valve (16) allows outside air to enter the canister (14). The purge valve (26), when open, allows fuel vapor to flow from the canister (14) into a vacuum source (12). A gas channel (28, 130, 168) extends between a vent chamber (18) within the vent valve (16) and a purge chamber (28) within the purge valve (26). When the purge valve (26) is open and a purge plunger (86) within the purge chamber (28) is positioned away from the gas channel (28, 130, 168), the manifold vacuum draws air from one side of a diaphragm (126) within the vent chamber (18) drawing the diaphragm (126) and a vent plunger (152) downward against a spring to close the vent valve (16). When the purge plunger (86) is positioned to block the gas channel (28, 130, 168), the spring forces the vent plunger (152) upward to open the vent valve (16). Therefore, a single actuator (36) is able to directly control purge closure position and to indirectly control vent closure position to either purge the canister (14) or evacuate the canister (14) to prepare for a leak check.

26 Claims, 4 Drawing Sheets

CANISTER VENT/PURGE VALVE

TECHNICAL FIELD

This invention relates generally to automotive evaporative emission control systems and, more particularly, to purge valves and vent valves that are used to purge and detect leaks in an evaporative fuel recovery system.

INVENTION BACKGROUND

Evaporative fuel recovery systems are used to recover volatile fuel vapors from the airspace in automotive vehicle fuel tanks. Some evaporative fuel recovery systems use vapor collection canisters filled with an activated carbon mixture. These canisters are in gaseous communication with the vehicle fuel tanks to allow the activated carbon mixture to adsorb fuel vapor from the airspace above the fuel disposed in the tanks. The adsorbed fuel vapor must be purged periodically from the vapor collection canisters to preclude over-saturation of the carbon mixture and to allow additional vapor adsorption to take place. In a number of such systems a purge line connects the canister to the engine intake manifold to allow the intake manifold vacuum to purge the canister by drawing adsorbed fuel from the canister into the engine combustion chambers. A purge valve is disposed between the engine intake manifold and the canister to control and regulate fuel vapor flow from the canister to the intake manifold. Canister purging is therefore accomplished by opening the purge valve to allow the engine intake manifold vacuum to draw air and fuel vapor into the intake manifold from the canister. From the intake manifold the air and fuel vapor are drawn into an engine combustion chamber to be burned. During normal purge operations, an atmosphere vent admits atmospheric air into the canister to replace the air and fuel vapor that the intake manifold has drawn out of the canister.

In some systems, to permit diagnostic leak detection, a vent valve is disposed inline with the atmosphere vent to control the flow of gasses between the canister and the atmosphere. Where a negative pressurization leak detect system is used, the vent valve is closed and the canister evacuated. A vacuum sensor then measures either the rate of vacuum loss, or how much energy is required to maintain the vacuum. Where a positive pressurization leak detect system is used, the vent valve is closed and a sensor measures either the rate of pressure dissipation or the amount of energy required to maintain a given pressure differential.

In systems that include both purge valves and vent valves, the two valves are physically separated. In addition, these systems include separate actuators to operate the respective valves. Therefore, the valves are actuated independently. Each of the following patents includes a system of this type having separate valves and a separate actuator for each valve:

| U.S. Pat. No. | Inventor |
|---|---|
| 5,411,004 | Busato, et al. |
| 5,437,257 | Giacomazzi, et al. |
| 5,450,833 | Denz, et al. |
| 5,460,141 | Denz, et al. |
| 5,499,614 | Busato, et al. |
| 5,542,397 | Takahata, et al. |
| 5,560,347 | Reddy, et al. |
| 5,562,084 | Shimamura |
| 5,562,757 | Brun, et al. |
| 5,613,477 | Maeda |

-continued

| U.S. Pat. No. | Inventor |
|---|---|
| 5,614,665 | Curran, et al. |
| 5,623,911 | Kiyomiya, et al. |
| 5,629,477 | Ito |
| 5,635,630 | Dawson et al. |

What is needed is an evaporative fuel recovery system that includes both a purge valve and a vent valve, is easier to assemble and operate and requires fewer parts.

INVENTION SUMMARY

A valve apparatus 10 comprising a master valve 26 including a master valve closure 34 movable to a shut position in which the master valve closure 34 prevents fluids from flowing through the master valve 26. The master valve closure 34 is additionally movable to at least one open position in which the master valve closure 34 allows fluids to flow through the master valve 26. The valve apparatus 10 also comprises a slave valve 16 that includes a slave valve closure 24 movable to a closed position in which the slave valve closure 24 prevents fluids from flowing through the slave valve 16. The slave valve closure 24 is additionally movable to an open position in which the slave valve closure 24 allows fluids to flow through the slave valve 16. An actuator is operably connected to the master valve closure 34 to move the master valve closure 34 between the shut and open positions.

The improvement comprises the slave valve 16 being coupled to the master valve 26 in such a way that master valve closure position controls slave valve closure position. Therefore, unlike the prior art, a single actuator 36 may be connected to the master valve 26 and used to move the master and slave valve closures 34, 24 to any of four possible closure position combinations, i.e., open-open, open-closed, closed-closed and closed-open.

BRIEF DRAWING DESCRIPTION

To better understand and appreciate the invention, refer to the following detailed description in connection with the accompanying drawings.

Figure 1:
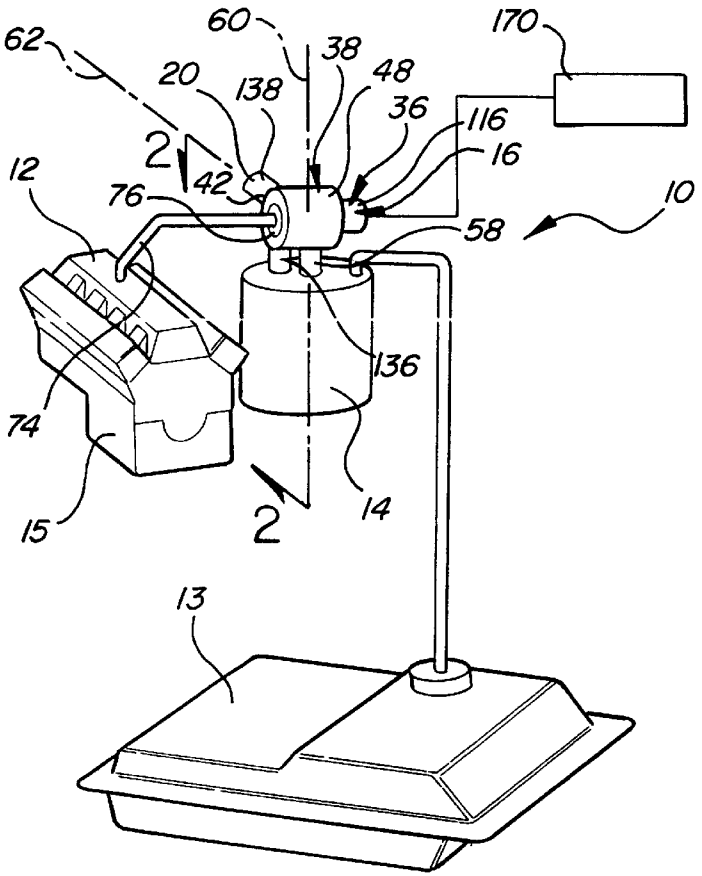
FIG. 1 is a diagrammatic perspective view of a combination vent valve/purge valve constructed according to the present invention and installed in an automotive fuel vapor recovery system.
Figure 4:
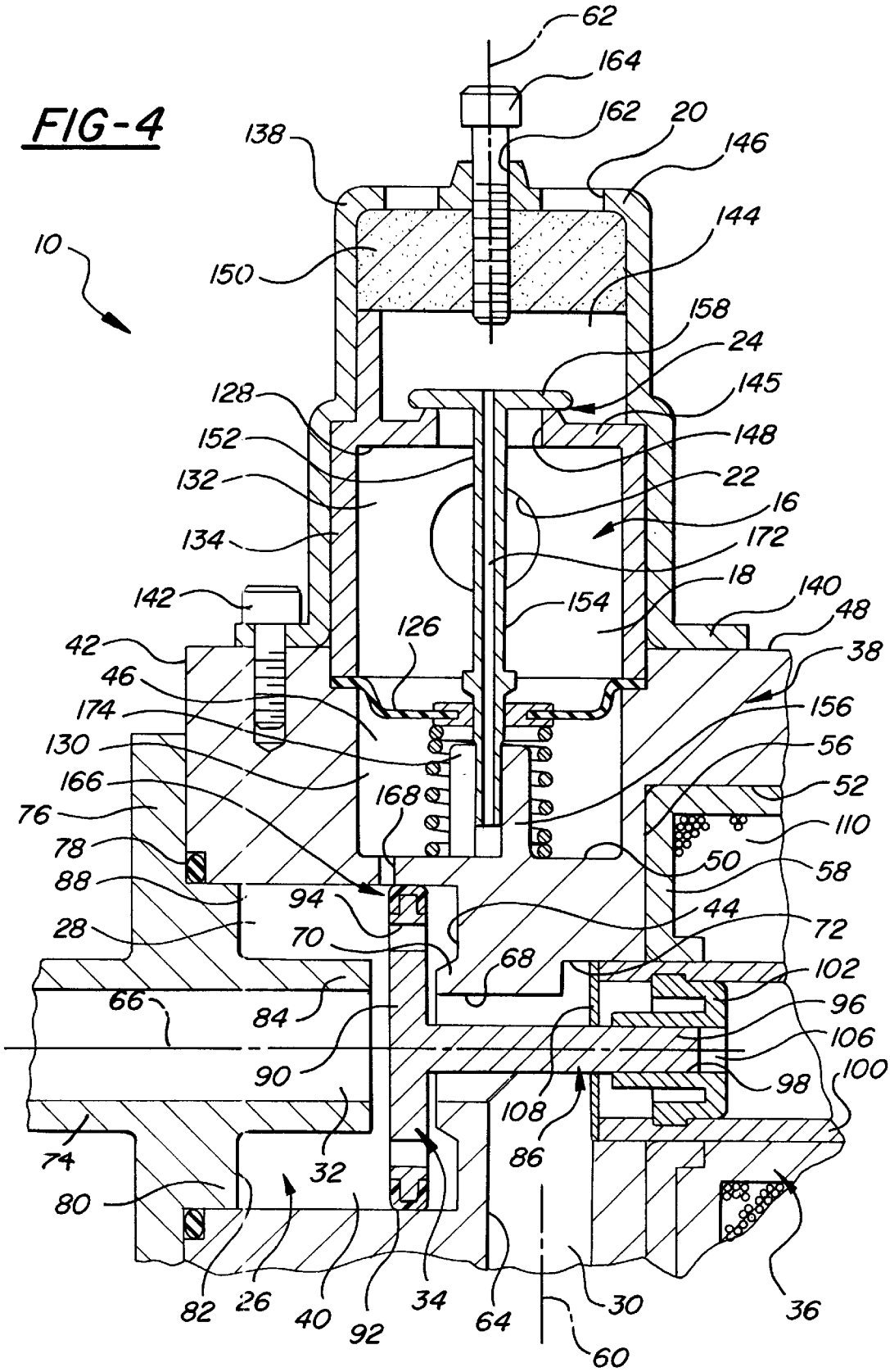
Figure 5:
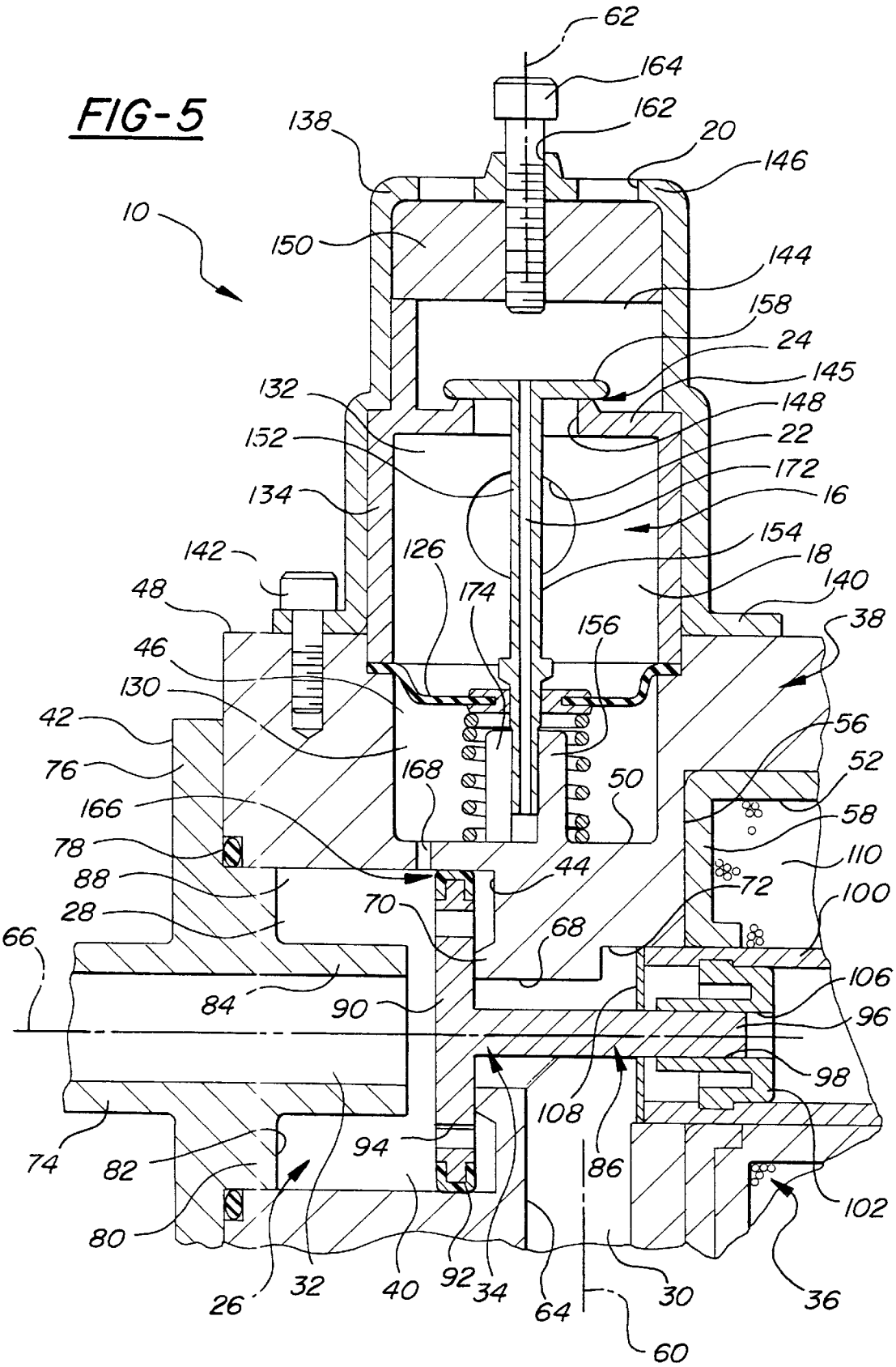

FIG. 4 is a fragmentary cross-sectional view of the combination vent valve/purge valve of FIG. 1 taken along line 2—2 of FIG. 1 with the purge closure within a second range of positions and the vent closure in a closed position; and FIG. 5 is a fragmentary cross-sectional view of the combination vent valve/purge valve of FIG. 1 taken along line 2—2 of FIG. 1 with the purge closure in a sealed position and the vent closure in a closed position.

DETAILED PREFERRED EMBODIMENT DESCRIPTION

A combination vent valve/purge valve apparatus is generally shown at 10 in FIGS. 1–5. In FIG. 1 the apparatus 10 is shown installed in an automotive fuel vapor recovery system comprising a fluid container in the form of a canister 14 containing activated charcoal connected between a fuel tank 13 and a fluid pressure source in the form of an engine intake manifold 12. The engine intake manifold 12 is included in an internal combustion engine 15 that, when running, produces negative gas pressure, i.e., a manifold vacuum, in the intake manifold 12. The manifold vacuum draws fuel and air into combustion chambers (not shown) located within the engine 15.

The combination vent valve/purge valve apparatus 10 comprises a slave valve in the form of a vent valve, generally indicated at 16 in FIGS. 1–5. As shown in FIGS. 2–5 the vent valve 16 includes a vent chamber 18 and an atmosphere vent 20 that provides gaseous communication between the vent chamber 18 and the outside atmosphere. An atmosphere port, shown at 22 in FIGS. 2–5, provides gaseous communication between the vent chamber 18 and the canister 14. A slave or vent closure, generally indicated at 24 in FIGS. 2–5, is mounted in the vent chamber 18 and is movable between a closed position shown in FIGS. 4 and 5, and a fully open position shown in FIGS. 1 and 2. In the closed position the vent closure 24 prevents gasses from flowing between the outside atmosphere and the canister 14. In the fully open position the vent closure 24 allows gasses to flow between the outside atmosphere and the canister 14.

The apparatus 10 also comprises a master valve in the form of a purge valve generally indicated at 26 in FIGS. 2–5. The purge valve 26 includes a purge chamber 28 and a vapor port 30 that provides gaseous communication between the purge chamber 28 and the canister 14. A vacuum port, shown at 32 in FIGS. 2–5, provides gaseous communication between the purge chamber 28 and the engine intake manifold 12.

A master or purge valve closure, generally indicated at 34 in FIGS. 2–5, is mounted in the purge chamber 28. The purge closure 34 is movable between a shut position shown in FIG. 2 and a fully open range of positions representatively shown in FIGS. 3 and 4. In the shut position the purge closure 34 prevents gasses and vapor from flowing between the canister 14 and the engine intake manifold 12. In the fully open position the purge closure 34 allows gasses and vapor to flow between the canister 14 and the engine intake manifold 12.

A solenoid actuator, generally indicated at 36 in FIGS. 1–5, is operably connected to the purge closure 34. As shown in FIGS. 2–5, the actuator 36 moves the purge closure 34 between the shut position shown in FIG. 2, the fully open range of positions representatively shown in FIGS. 3 and 4, and a sealed position shown in FIG. 5. The purge closure 34 is also operably connectable to the vent closure 24 to allow the actuator 36 to indirectly control vent closure position by controlling purge closure 34 position as is more fully explained below.

Figure 2:
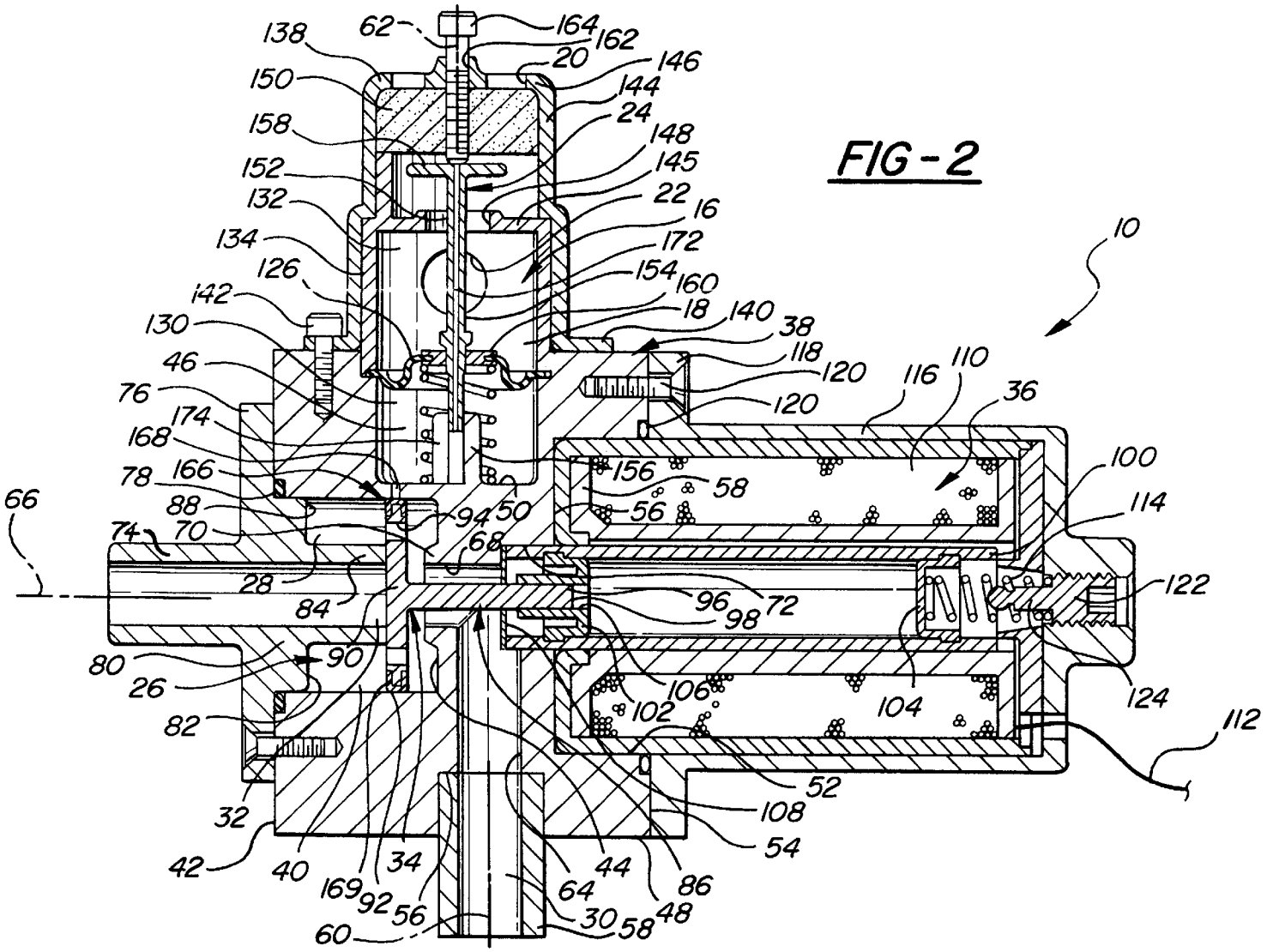
FIG. 2 is a cross-sectional view of the combination vent valve/purge valve of FIG. 1 taken along line 2—2 of FIG. 1 with a purge closure of the invention in a shut position and a vent closure of the invention in an open position.

The purge valve 26 and vent valve 16 are disposed in a single unitary valve housing, generally indicated at 38 in FIGS. 1–5. As is best shown in FIGS. 1 and 2, the valve housing 38 includes a generally solid cylindrical metal block with four cylindrical recesses and two cylindrical channels. The channels are machined into the block from outer surfaces of the housing 38.

One of the four cylindrical recesses is a purge valve recess 40 that is formed axially inward from a generally flat first end wall 42 of the housing 38 and terminates at an axial inner end wall 44 of the recess 40.

Another of the four recesses is a vent valve recess shown at 46 in FIGS. 2–5. The vent valve recess 46 is formed radially inward from an arcuate side wall 48 of the housing 38 and terminates at a radial inner end wall 50 of the vent valve recess 46.

Another of the recesses is an actuator recess shown at 52 in FIGS. 2–5. The actuator recess 52 is formed axially inward from a generally flat second end wall shown at 54 in FIG. 2. The second end wall 54 is disposed opposite the first end wall 42 and terminates at an axial inner end wall 56 of the actuator recess 52. The actuator recess 52 is shaped to receive a generally cylindrical inner end 58 of the actuator 36.

The remaining cylindrical recess is a vapor port recess shown at 56 in FIG. 2. The vapor port recess 56 is formed radially inward from the arcuate sidewall of the housing 38 and terminates at an annular seat or rim. The vapor port recess 56 is shaped to receive and seat a hollow cylindrical vapor port tube shown at 58 in FIGS. 1 and 2. As shown in FIG. 1, the vapor port tube 58 connects the combination vent valve/purge valve assembly 10 to the canister 14. As is also shown in FIG. 1, the vapor port recess 56 and vapor port tube 58 have a common central axis 60 disposed at an approximate 90 degree angle to a central axis 62 of the vent valve 16 and vent valve recess 46. (In FIGS. 2–5 the vapor port recess 56 is shown at a 180-degree angle to the vent valve recess 46 for clarity.)

A first cylindrical channel, shown at 64 in FIGS. 2–5, is formed radially into the valve housing 38 concentric with the vapor port recess 56. The first cylindrical channel 64 terminates just past the point where it intersects with an extended central axis 66 of the purge valve recess 40. The first cylindrical channel 64 has a radius smaller than the radius of the vapor port recess 56 by an amount approximately equal to a wall thickness of the vapor port tube 58.

A second cylindrical channel is shown at 68 in FIGS. 2–5. The second cylindrical channel 68 is formed axially into the valve housing 38 concentric with the purge valve recess 40. The second cylindrical channel 68 intersects the first cylindrical channel 64 to form a fluid passageway between the purge chamber 28 and the vapor port tube 58. The radius of the second cylindrical channel 68 is approximately one third that of the purge valve recess 40. An annular lip 70 extends axially outward from a portion of the inner end wall 44 of the purge valve recess 40 surrounding the second cylindrical channel 68.

The actuator recess 52 includes a counterbore 72 that extends axially inward from the actuator recess inner end wall 56 and intersects the first cylindrical channel 64. The counterbore 72 provides an axial passageway between the actuator recess 52 and the purge valve recess 40.

The purge valve 26 includes a metal vacuum port tube shown at 74 in FIGS. 1–5. An annular disk-shaped metal purge chamber cover flange 76 extends integrally and radially outward from an approximate mid point along a length of the vacuum port tube 74. Screws fasten the cover flange 76 to the first end wall 42 of the housing 38 in a position coaxially covering the purge valve recess 40 and closing the purge chamber 28. An O-ring seal 78 is disposed between the cover flange 76 and the housing 38. An annular protrusion 80 extends axially and integrally inward from the cover flange 76 and into the purge chamber 28. An inner annular surface of the annular protrusion defines an outer end wall 82 of the purge chamber 28. The vacuum port tube 74 is supported coaxially along the purge chamber axis 66. An inner end 84 of the vacuum port tube 74 extends approximately ⅔ of the distance into the purge chamber 28 from the outer end wall 82 and is spaced axially from the annular lip 70 that extends axially outward from around the second cylindrical channel 68.

The purge closure 34 comprises a purge plunger, generally indicated at 86 in FIGS. 2–5, and a cylindrical inner side wall 88 of the purge chamber 28. The purge plunger 86 includes a disk-shaped purge plunger head 90 with a peripheral rim surface 92 that sealingly and slidably engages the cylindrical inner side wall of the purge chamber 28. The purge plunger head 90 is coaxially disposed and is supported for reciprocal axial motion between the inner end 84 of the vacuum port tube 74 and the annular lip 70 around the second cylindrical channel 68. A plurality of axially-oriented through holes 94 extend through the thickness of the purge plunger head 90 in a spaced-apart disposition adjacent the peripheral rim 92 of the purge plunger head 90. The purge plunger head 90 is supported on a purge plunger stem 96 that extends integrally and axially inward from the head 90, through the second cylindrical channel 68 and the actuator recess counterbore 72. The actuator 36 drivingly engages a distal end 98 of the purge plunger stem 96. This allows the actuator 36 to drive the purge plunger head 90 back and forth between the inner end 84 of the vacuum port tube 74 and the annular lip 70 around the second cylindrical channel 68.

The actuator 36 is a solenoid that includes a moving armature tube shown at 100 in FIGS. 2–5. The moving armature tube 100 has an inner annular plug 102 fixed within an axial inner end of the armature tube 100 and an outer plug 104 fixed within an axial outer end of the tube 100. The inner plug 102 has a central bore 106 for receiving the distal end 98 of the purge plunger stem 96 in an interference fit. An annular washer cap 108 closes the inner end of the armature tube 100 and has a central hole that supports the purge plunger stem 96. The armature tube 100 is slidably supported within a coil 110 for movement along a linear reciprocal path. A wire lead shown at 112 in FIG. 2 extends from the coil 110 to an electronic control module or the like (not shown).

When energized, the coil 110 draws the armature tube 100 and purge plunger 86 to the right as viewed in FIGS. 2–5 which draws the plunger head 90 toward the annular lip 70 and away from the vacuum port tube 74. As shown in FIG. 2, a coil-type armature spring, shown at 114, engages the outer plug 104 within the armature tube 100, biasing the armature tube 100 to the left and biasing the plunger head 90 toward the vacuum port tube 74 and away from the annular lip 70. The amount of electrical power applied to the coil 110 in the form of a pulse width modulated signal determines plunger head position between the vacuum port tube 74 and the annular lip 70.

The actuator 36 is coupled to the purge valve 26 to control opening and closing of the purge valve 26. The actuator 36 is also coupled to the vent valve 16 to control opening and closing of the vent valve 16. The actuator 36 is movable between a first position (shown in FIG. 2) in which the purge valve 26 is closed and the vent valve 16 is open, a second position (shown in FIG. 3) in which the purge valve 26 and vent valve 16 are both open, a third position (shown in FIG. 5) in which the purge and vent valves 26, 16 are closed, and a fourth position (shown in FIG. 4) in which the purge valve 26 is open and the vent valve 16 is closed.

A cup-shaped metal solenoid cover is shown at 116 in FIGS. 1 and 2. The solenoid cover 116 encloses an axially outer portion of the solenoid actuator 36 not enclosed within the actuator recess 52. The solenoid cover 116 has an annular flange 118 at its axial inner end. Screw-type fasteners 120 extend through holes in the annular flange 118 and threadedly engage holes in the housing 38 to fasten the solenoid cover 116 to the housing 38. An O-ring seal 120 is disposed between the annular flange 118 and the housing 38.

Armature spring biasing force may be adjusted by turning a setscrew shown at 122 in FIG. 2. The setscrew 122 is threadedly engaged within a hole disposed through an axial outer end of the solenoid cover 116. An inner end of the setscrew 122 serves as a spring seat. The set screw 122 also includes an axially inwardly extending cylindrical projection 124 that fits within an outer end of the armature spring 114 and serves as a spring retainer.

As shown in FIGS. 2–5, the slave or vent valve 16 includes an annular diaphragm 126 that is mounted in the vent chamber 18. The diaphragm 126 has a peripheral edge that is connected and sealed to an inner wall of the vent chamber 18 approximately midway between an outer end 128 of the vent chamber 18 and the axial inner end 50 of the vent valve recess 46 in the housing 38. The diaphragm 126 divides the vent chamber 18 into inner and outer vent chamber portions 130, 132. The inner vent chamber portion 130 is defined by the portion of the diaphragm 126 that closes the vent valve recess 46 in the housing 38. The outer vent chamber portion 132 is defined by the diaphragm 126 and an inverted annular metal cup 134. The peripheral edge of the diaphragm 126 is secured to the inner wall of the vent chamber 18 by being clamped between the housing 38 and a lower rim of the inverted cup 134. As is best shown in FIG. 1, a vent tube 136 extends radially outward from the outer vent chamber portion forming the atmosphere port 22. As FIG. 1 also shows, the vent tube 136 is disposed parallel to the vapor tube 58 and extends from the vent valve 16 to the canister 14.

A metal vent cover shown at 138 in FIGS. 1–5 also has the shape of an inverted cup. As shown in FIGS. 2–5 the vent cover 138 covers the annular metal cup 134 and has an attachment flange 140 that extends radially outward from a lower rim of the vent cover 138 that rests on the housing 38. Screw fasteners 142 attach the vent cover 138 to the housing 38 by passing through holes in the attachment flange 140 and threadedly engaging interiorly threaded holes in the housing 38. The vent cover 138 has a length greater than that of the annular cup 134. A filter chamber 144 is therefore formed within the vent cover 138 between an outer end 145 of the annular cup 134 and an outer end 146 of the vent cover 138. An inner vent hole 148 is formed through the outer end 145 of the annular cup 134 and a plurality of vent holes in the outer end of the vent cover form the atmosphere vent 20. A known air filtering material 150 is supported in the filter chamber 144 between the inner vent hole 148 and the atmosphere vent 20 adjacent the outer end 146 of the vent cover 138. The atmosphere vent 20, filter chamber 144, vent valve 16, outer vent chamber portion 132, atmosphere port 22 and vent tube 136 provide a passageway for gasses to flow from the ambient atmosphere into the canister 14.

As shown in FIGS. 2–5 the vent closure 24 comprises a vent plunger 152 having a vent plunger stem 154 that is mounted concentrically to the vent valve diaphragm 126. The vent plunger stem 154 is slidably supported for linear reciprocal motion within a generally annular spring seat 156. The spring seat 156 extends integrally outward from the inner wall 50 of the vent valve recess 46 in the valve housing 38. The vent plunger stem 154 extends coaxially through the inner vent hole 148 in the annular cup 134 to an outer end of the plunger stem 154. A disk-shaped vent plunger head 158 is integrally formed on the outer end of the plunger stem 154 and has a diameter larger than that of the inner vent hole 148.

The vent plunger 152 is reciprocally movable with the diaphragm 126 in an axial direction generally perpendicular to a diaphragm plane. The diaphragm plane is defined as being an imaginary plane that extends perpendicular to the length of the vent plunger stem 154 and intersects the stem where the diaphragm attaches to the stem. The vent plunger 152 is axially movable between an open position and a closed position. In the open position the vent plunger head 158 is spaced from the inner vent hole 148 allowing gasses to pass between the atmosphere and the canister 14 through the vent valve 16. In the closed position the plunger head 158 is in sealing engagement over the inner vent hole 148, closing the inner vent hole and preventing gasses from passing between the atmosphere and the canister 14 through the vent valve 16.

A coil vent spring 160 is seated on the spring seat and biases the diaphragm 126 and vent plunger 152 axially outward toward the open position and away from the inner wall 50 of the vent valve recess 46 in the housing 38.

As will be discussed, the invention provides differential pneumatic pressure selectively across diaphragm 126 so as to control vent valve diaphragm position by pulling the diaphragm 126 and plunger 152 inward against the outward biasing spring force toward the closed position. Thus, the presence or absence of differential pneumatic pressure across diaphragm 126 operates the vent valve 16 by moving the vent closure 24 between the closed and open positions, respectively.

As shown in FIGS. 2–5 the axial outer end wall 146 of the vent cover 138 includes a central interiorly threaded through-hole 162. An adjustment screw 164 is threadedly engaged in the through-hole 162 and extends axially inward to contact the vent plunger head 158 when the vent closure 24 is in the open position shown in FIGS. 2 and 3. The adjustment screw 164 allows an operator to adjust vent plunger position when the vent closure 24 is in the open position.

As shown in FIGS. 2–5, the inner vent chamber portion 130 is in gaseous communication with the purge chamber 28 and the engine intake manifold 12 through an interflow valve generally indicated at 166 in FIGS. 2–5. The interflow valve 166 is disposed in a fluid or gas channel that extends between the vent closure 24 and the purge closure 34 and allows gasses to pass between the inner vent chamber portion 130 and the engine intake manifold 12. Thus, there is an operative connection between the master (purge) valve and the slave (vent) valve in the form of a fluid or gas channel. The fluid or gas channel includes the inner vent chamber portion 130, the purge chamber 28 and a small aperture 168 that connects the two chambers 130, 28. The small aperture 168 extends from the inner end wall 50 of the vent chamber 18 to the side wall 88 of the purge chamber 28. The interflow valve 166 comprises the purge plunger 86, the axial inner end 84 of the vacuum port tube 74 and a lower opening of the aperture 168 where the aperture 168 opens out into the purge chamber 28. The purge plunger 86 is movable to a position within the purge chamber 28 in which an annular channel shaped seal 169 defining the peripheral rim surface 92 of the purge plunger 86 opens or closes the aperture 168 for controlling the flow of gasses through the gas channel 28, 130, 168.

The diaphragm 126 and vent plunger 152 are movable to the closed position shown in FIGS. 4 and 5 in response to gas being drawn out of the inner vent chamber portion 130 through the interflow valve 166 and the gas channel 28, 130, 168 into the manifold 12. This occurs when the interflow valve 166 is open and the purge closure 34 is out of the shut position as shown in FIGS. 4 and 5. Thus, the purge closure 34 is operably connectable to the vent closure 24 by gaseous communication through the gas channel 28, 130, 168 and the vent closure 24 is actuable to the closed position by a flow of gas through the gas channel 28, 130, 168.

As shown in FIG. 2, when the actuator 36 is in the first position and the purge closure 34 is in the shut position, the seal 169 on the purge plunger head 90 blocks the aperture 168 isolating the vent chamber 18 from the intake manifold vacuum. Also in the shut position the purge closure 26 blocks the vacuum port 32 by positioning the purge plunger head 90 in sealed engagement with inner end 84 of the vacuum port tube 74.

Figure 3:
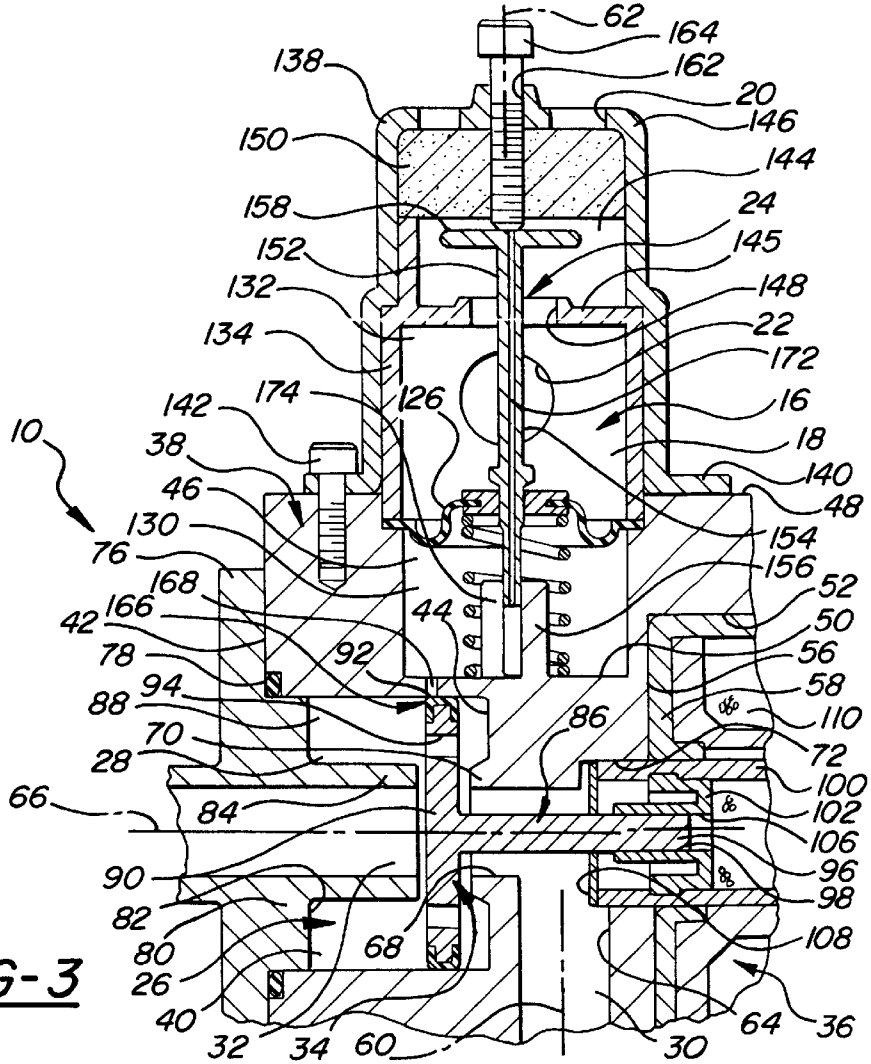
FIG. 3 is a fragmentary cross-sectional view of the combination vent valve/purge valve of FIG. 1 taken along line 2—2 of FIG. 1 with the purge closure within a first range of positions and the vent closure in an open position.

As shown in FIG. 3, the purge closure 34 has a first range of positions in which the purge plunger 86 blocks the aperture 168 but does not block the vacuum port 32. Therefore, in the first range of positions the purge plunger allows the manifold vacuum to purge the canister 14.

FIG. 4 shows the purge closure 34 in a second range of positions. In the second range of positions the purge plunger head 90 is spaced from port tube 74 to open the vacuum port 32 and the aperture 168. Therefore, in the second range of positions the purge plunger allows the intake manifold vacuum to draw air from the inner portion of the vent chamber 18 through the purge chamber 28. As air is drawn from the inner portion of the vent chamber 18 it creates a pressure differential across the vent diaphragm 126, i.e., a vacuum in the inner vent chamber 130, that pulls the vent diaphragm 126 and vent plunger 152 downward. At the limit of its downward travel the vent plunger 152 positions the vent plunger head 158 against an annular, raised valve seat 148*a* surrounding vent hole 148. In such closed position, the vent plunger 152 prevents outside air from being drawn into the canister 14. With the vent valve 16 thus sealed and the purge plunger 86 clear of the vacuum port 32 and the aperture 168, the manifold vacuum evacuates the canister 14.

To aid in breaking the inner vent chamber vacuum and unsealing the vent valve 16 when canister evacuation is complete, the vent plunger 152 includes a longitudinal vacuum release tube 172 that runs the entire vertical length of the vent plunger 152. The vacuum release tube 172 provides a path for gas to travel to the inner vent chamber 130 from the atmosphere vent 20 when the vent plunger 152 is moved out of the closed position. To further aid in releasing a vacuum condition in the inner vent chamber 130, the spring seat 156 includes a vertical slot 174 that allows gas to flow more freely from a lower end of the release tube 172 into the inner vent chamber 130.

As shown in FIG. 5, in the sealed position the actuator 36 is in its third position that disposes the purge closure 34 in a sealed position axially opposite the shut position. In the sealed position the purge plunger 86 is clear of the aperture 168 and the plunger head 90 thereon engages annular lip 70 to close the vapor port 30 from purge chamber 28. With the purge plunger 86 in the sealed position the manifold vacuum closes the vent valve 16 and the purge closure 34 shuts off air and vapor flow from the canister 14 into the engine intake manifold 12. This seals-off the canister 14. If the canister 14 has already been evacuated as described above, moving the purge closure 34 to the sealed position will seal-off the canister 14. It will also maintain the vacuum therein for a test period to assure there are no leaks in the canister 14 for testing for leakage therefrom during a test period.

Rather than evacuating the canister 14, the purge closure 34 may be moved, by suitable control of solenoid actuator 36, to the sealed position to seal-off the canister 14. A source of pressurized gas such as an air pump may then be connected to the canister 14 to pressurize the canister 14.

To periodically purge fuel vapor from the activated carbon mixture within the canister 14, an electronic controller 170 or other suitable signal source energizes the solenoid actuator 36 to drive the head 90 of the purge plunger 86 to the first range of positions shown in FIG. 3. As explained above, in the first range of positions the purge plunger head 90 blocks the aperture 168 between the vent chamber 18 and the purge chamber 28 but leaves the vacuum port 32 open. With the aperture 168 blocked the vent closure 24 remains in its spring-biased open position. With the vacuum port 32 open the manifold vacuum is able to draw fuel vapor from the canister 14 as outside air is being drawn in through the open vent valve 16. The fuel vapor is drawn into engine combustion chambers (not shown) through the engine intake manifold 12 and is burned. After a preset period of time the electronic controller 170 de-energizes the coil 110 in the solenoid actuator 36 which allows the biasing spring 114 to return the purge plunger head 90 to the shut position shown in FIG. 2. In the shut position the purge plunger head 90 closes off both the aperture 168 and the vacuum port 32.

To prepare the canister 14 for a vacuum leak check, the electronic controller 170 sends a signal to the solenoid actuator 36 that causes the actuator to move the purge plunger 86 to the second range of positions shown in FIG. 4. As described above, in the second range of positions the purge plunger head 90 allows the manifold vacuum to evacuate the canister 14 by drawing vapor from the canister 14 through the vacuum port 32. The manifold vacuum simultaneously draws the vent valve diaphragm 126 and plunger downward to prevent outside air from replacing the fuel vapor drawn from the canister 14. A second signal is then sent to the actuator 36 that causes the actuator 36 to move the purge plunger 86 to the sealed position for testing shown in FIG. 5. In the sealed position the vent closure 24 remains in the closed position and the vacuum port 32 is closed. Instruments may be attached to the canister 14 to measure the rate of vacuum pressure loss within the canister 14. Alternatively, the electronic controller 170 may be programmed to determine canister leakage by measuring the amount of electrical energy the actuator requires to hold the purge plunger head 90 far enough out of the sealed position to maintain a given negative pressure differential between the canister 14 and the outside atmosphere. In addition, prior to moving the purge plunger 86 to the second range of positions, a signal may be sent to the actuator 36 to move the plunger to the first range of positions to purge the canister 14 prior to evacuating the canister 14.

To prepare the canister 14 for a positive-pressure leak check, the canister 14 is first sealed-off by signaling the actuator 36 to move the purge plunger 86 to the sealed position shown in FIG. 5. Pressurized gas is then provided within the canister 14 by an air pump or the like (not shown). A pressure gauge (not shown) may be attached to the canister 14 so that the canister 14 leakage may be determined by the rate of pressure drop within the canister 14. Alternatively, canister leakage may be determined by measuring the amount of energy required to pump enough air into the canister to maintain a constant positive pressure differential between the canister 14 and the outside atmosphere despite the leakage. By this method, the leakage rate at a given pressure will equal the rate at which air must be pumped into the canister to maintain the given pressure.

The description and drawings illustratively set forth my presently preferred invention embodiments. I intend the description and drawings to describe these embodiments and not to limit the scope of the invention. Obviously, it is possible to modify these embodiments while remaining within the scope of the following claims. Therefore, within the scope of the claims, one may practice the invention otherwise than as the description and drawings specifically show and describe.

I claim:

1. In a valve apparatus (10) comprising:

a master valve (26) including a master valve closure (34) movable to a shut position in which the master valve closure (34) prevents fluids from flowing through the master valve (26), the master valve closure (34) additionally movable to at least one open position in which the master valve closure (34) allows fluids to flow through the master valve (26);

a slave valve (16) including a slave valve closure (24) movable to a closed position in which the slave valve closure (24) prevents fluids from flowing through the slave valve (16), the slave valve closure (24) being additionally movable to an open position in which the slave valve closure (24) allows fluids to flow through the slave valve (16);

an actuator (36) operably connected to the master valve closure (34) to move the master valve closure (34) between the shut and open positions; the improvement comprising:

the slave valve (16) coupled to the master valve (26) so that master valve closure position controls slave valve closure position.

2. A valve apparatus (10) as set forth in claim 1 in which:

the apparatus (10) includes either a positive or a negative pressure source (12) connected to the master valve (26);

a fluid channel (28, 130, 168) connects the slave valve (16) to the master valve (26);

predetermined positions of the master valve closure (34) allow fluid communication between the slave valve closure (24) and the pressure source (12); and the slave valve closure (24) is actuable between the closed and open positions by the fluid communication through the fluid channel (28, 130, 168).

3. A valve apparatus (10) as set forth in claim 2 in which:

the master valve closure (34) blocks fluid communication between the pressure source (12) and the slave valve closure (24) when the master valve closure (34) is in the shut position; and the master valve closure (34) is additionally movable to a sealed position in which the master valve closure (34) prevents fluids from flowing through the master valve (26) between the pressure source (12) and a fluid container (14) connected to the master valve (26) but allows fluid communication between the pressure source (12) and the slave valve closure (24).

4. A valve apparatus (10) as set forth in claim 2 in which:

the master valve closure (34) blocks fluid communication between the pressure source (12) and the slave valve closure (24) when the master valve closure (34) is in the shut position; and the master valve closure (34) is additionally movable to at least one open position in which the master valve closure (34) allows fluids to flow between the pressure source (12) and the fluid container (14) connected to the master valve (26) but prevents fluid communication between the pressure source (12) and the slave valve closure (24).

5. A valve apparatus (10) as set forth in claim 2 in which:

the master valve closure (34) blocks fluid communication between the pressure source (12) and the slave valve closure (24) when the master valve closure (34) is in the shut position; and the master valve closure (34) is additionally movable to at least one open position in which the master valve closure (34) allows fluids to flow between the pressure source (12) and the fluid container (14) connected to the master valve (26) and also allows fluid communication between the pressure source (12) and the slave valve closure (24).

6. In a valve apparatus (10) having a first valve (26) and an actuator (36) coupled to the first valve (26) to control opening and closing of the first valve (26), the actuator (36) being movable between a first position in which the first valve (26) is closed and a second position in which the first valve (26) is open; the improvement comprising:

a second valve (16) coupled to the actuator (36), wherein the actuator (36) has a third position in which the first valve (26) is closed and a fourth position in which the first valve (26) is open; and wherein the actuator (36) is coupled to the second valve (16) to control opening and closing of the second valve (16) with the second valve being open when the actuator (36) is in either the first or second positions and is closed when the actuator (36) is in either the third or fourth positions.

7. In a combination vent valve/purge valve apparatus (10) for a fuel vapor recovery system comprising a vacuum source (12) and a canister (14) containing activated charcoal, the apparatus (10) comprising:

a vent valve (16) including a vent chamber (18), an atmosphere vent (20) providing gaseous communication between the vent chamber (18) and the outside atmosphere, an atmosphere port (22) providing gaseous communication between the vent chamber (18) and the canister (14), and a vent closure (24) mounted in the vent chamber (18) and movable between a closed position preventing gasses from flowing between the outside atmosphere and the canister (14) and a fully open position allowing gasses to flow between the outside atmosphere and the canister (14);

a purge valve (26) including a purge chamber (28), a vapor port (30) providing gaseous communication between the purge chamber (28) and the canister (14), a vacuum port (32) providing gaseous communication between the purge chamber (28) and the vacuum source (12), and a purge closure (34) mounted in the purge chamber (28) and movable between a shut position preventing gasses and vapor from flowing between the canister (14) and the vacuum source (12) and a fully open position allowing gasses and vapor to flow between the canister (14) and the vacuum source (12);

an actuator (36) operably connected to the purge closure (34) to move the purge closure (34) between the shut and fully open positions; the improvement comprising:

the purge closure (34) being operably connectable to the vent closure (24) to allow the actuator (36) to control vent closure position by controlling purge closure position.

8. A combination vent valve/purge valve apparatus (10) as defined in claim 7 further including an interflow valve (166) disposed in a gas channel (28, 130, 168) extending between the vent closure (24) and the purge closure (34), the purge closure (34) being operably connectable to the vent closure (24) by gaseous communication through the gas channel (28, 130, 168), the vent closure (24) being actuable to the closed position by a flow of gas through the gas channel (28, 130, 168), the interflow valve (166) actuable to initiate and terminate the flow of gas through the gas channel (28, 130, 168).

9. A combination vent valve/purge valve apparatus (10) as defined in claim 8 further including a single valve housing (38), the purge valve (26) and vent valve (16) being disposed in said single valve housing (38).

10. A combination vent valve/purge valve apparatus (10) as defined in claim 8 in which:

the vent valve (16) includes a diaphragm (126) mounted in the vent chamber (18), the diaphragm (126) having a peripheral outer edge sealed to an inner wall of the vent chamber (18) and dividing the vent chamber (18) into inner and outer vent chamber portions (130, 132);

the inner vent chamber portion (130) being in gaseous communication with the purge chamber (28) through the interflow valve (166);

the vent closure (24) comprising a vent plunger (152) mounted to the vent valve diaphragm (126) and reciprocally movable with the diaphragm (126) in a direction generally perpendicular to a diaphragm plane between an open position allowing gasses to pass between the atmosphere and the canister (14) through the vent valve (16) and a closed position preventing gasses from passing between the atmosphere and the canister (14) through the vent valve (16); and the diaphragm (126) and vent plunger (152) are spring biased into the open position, the diaphragm (126) and vent plunger (152) being movable to the closed position in response to gas being drawn out of the inner vent chamber portion (130) through the interflow valve (166) when the interflow valve (166) is open.

11. A combination vent valve/purge valve apparatus (10) as defined in claim 9 in which the interflow valve (166) comprises:

a purge plunger (86) portion of the purge closure (34); and an aperture (168) in the valve housing (38) extending between the purge chamber (28) and the inner vent chamber portion (130) of the vent valve (16), the purge plunger (86) being movable to a position in which a portion of the purge plunger (86) closes the aperture (168).

12. A combination vent valve/purge valve apparatus (10) as defined in claim 11 in which:

the purge plunger (86) blocks the aperture (168) and the vacuum port (32) when the purge closure (34) is in the shut position;

the purge closure (34) has a first range of positions in which the purge plunger (86) blocks the aperture (168) but does not block the vacuum port (32); and the purge closure (34) has a second range of positions in which the purge plunger (86) is clear of the vacuum port (32) and the aperture (168).

13. A combination vent valve/purge valve apparatus (10) as defined in claim 12 in which the purge closure (34) has a sealed position in which the purge plunger (86) is clear of the aperture (168) and blocks the vapor port (30).

14. A combination vent valve/purge valve apparatus (10) as defined in claim 13 in which the actuator (36) is a solenoid and the purge plunger (86) is movable by the solenoid (36) along a linear reciprocal path between the shut position and the sealed position.

15. In a combination vent valve/purge valve apparatus (10) for a fuel vapor recovery system comprising a vacuum source (12) and a canister (14) containing activated charcoal, the apparatus (10) comprising:

a valve housing (38);

a vent valve (16) disposed in the valve housing (38), the vent valve (16) including a vent chamber (18), an atmosphere vent (20) providing gaseous communication between the vent chamber (18) and the outside atmosphere, an atmosphere port (22) providing gaseous communication between the vent chamber (18) and the canister (14), and a vent closure (24) mounted in the vent chamber (18) and movable between a closed position preventing gasses from flowing between the outside atmosphere and the canister (14) and a fully open position allowing gasses to flow between the outside atmosphere and the canister (14);

a purge valve (26) including a purge chamber (28), a vapor port (30) providing gaseous communication between the purge chamber (28) and the canister (14), a vacuum port (32) providing gaseous communication between the purge chamber (28) and the vacuum source (12), and a purge closure (34) mounted in the purge chamber (28) and movable between a shut position preventing gasses and vapor from flowing between the canister (14) and the vacuum source (12) and a fully open position allowing gasses and vapor to flow between the canister (14) into the vacuum source (12); the improvement comprising:

said valve housing (38) being a unitary housing having said purge valve (26) disposed therein adjacent the vent valve (16).

16. A combination vent valve/purge valve apparatus (10) as defined in claim 15 further including an actuator (36) operably connected to the purge closure (34) to move the purge closure (34) between the shut and fully open positions.

17. A combination vent valve/purge valve apparatus (10) as defined in claim 15 in which the purge closure (34) is operably connectable to the vent closure (24).

18. A combination vent valve/purge valve apparatus (10) as defined in claim 17 further including an interflow valve (166) disposed in a gas channel (28, 130, 168) extending between the vent closure (24) and the purge closure (34), the purge closure (34) being operably connectable to the vent closure (24) by gaseous communication through the gas channel (28, 130, 168), the vent closure (24) being actuable to the closed position by a flow of gas through the gas channel (28, 130, 168), the interflow valve (166) actuable to initiate and terminate the flow of gas through the gas channel (28, 130, 168).

19. A combination vent valve/purge valve apparatus (10) as defined in claim 18 in which:

the vent valve (16) includes a diaphragm (126) mounted in the vent chamber (18), the diaphragm (126) having a peripheral outer edge sealed to an inner wall of the vent chamber (18) and dividing the vent chamber (18) into inner and outer vent chamber portions (130, 132), the inner vent chamber portion (130) being in gaseous communication with the purge chamber (28) through the interflow valve (166);

the vent closure (24) comprising a vent plunger (152) mounted to the vent valve diaphragm (126) and reciprocally movable with the diaphragm (126) in a direction generally perpendicular to a diaphragm plane between an open position allowing gasses to pass between the atmosphere and the canister (14) through the vent valve (16) and a closed position preventing gasses from passing between the atmosphere and the canister (14) through the vent valve (16); and the diaphragm (126) and vent plunger (152) are spring biased into the open position, the diaphragm (126) and vent plunger (152) being movable to the closed position in response to gas being drawn out of the inner vent chamber portion (130) through the interflow valve (166) when the interflow valve (166) is open.

20. A combination vent valve/purge valve apparatus (10) as defined in claim 19 in which the interflow valve (166) comprises:

a purge plunger (86) portion of the purge closure (34); and an aperture (168) in the valve housing (38) extending between the purge chamber (28) and the inner vent chamber portion (130) of the vent valve (16), the purge plunger (86) being movable to a position in which a portion of the purge plunger (86) closes the aperture (168).

21. A combination vent valve/purge valve apparatus (10) as defined in claim 20 in which:

the purge plunger (86) blocks the aperture (168) and the vacuum port (32) when the purge closure (34) is in the shut position;

the purge closure (34) has a first range of positions in which the purge plunger (86) blocks the aperture (168) but does not block the vacuum port (32); and the purge closure (34) has a second range of positions in which the purge plunger (86) is clear of the vacuum port (32) and the aperture (168).

22. A combination vent valve/purge valve apparatus (10) as defined in claim 21 in which the purge closure (34) has a sealed position in which the purge plunger (86) is clear of the aperture (168) and blocks the vapor port (30).

23. A method for evacuating and sealing a fuel vapor recovery system canister (14) to prepare the canister (14) for a vacuum leak check, the fuel vapor recovery system comprising an engine intake manifold having a vacuum source (12) in gaseous communication with the canister (14) and a fuel tank (13) in gaseous communication with the canister (14); the method including the steps of:

providing a combination canister vent/purge valve apparatus (10) between the vacuum source (12) and the canister (14), the apparatus (10) comprising a vent valve (16) that includes a vent chamber (18), an atmosphere vent (20) providing gaseous communication between the vent chamber (18) to the outside atmosphere, an atmosphere port (22) providing gaseous communication between the vent chamber (18) and the canister (14), and a vent closure (24) mounted in the vent chamber (18) and movable between a closed position preventing gasses from flowing between the outside atmosphere and the canister (14) and a fully open position allowing gasses to flow between the outside atmosphere and the canister (14), a purge valve (26) including a purge chamber (28), a vapor port (30) providing gaseous communication between the purge chamber (28) and the canister (14), a vacuum port (32) providing gaseous communication between the purge chamber (28) and the vacuum source (12), and a purge closure (34) movably mounted in the purge chamber (28) and movable from a shut position in which the purge closure (34) prevents gasses and vapor from flowing between the canister (14) and the vacuum source (12); the purge closure (34) being operably connectable to the vent closure (24);

evacuating the canister (14) by moving the purge closure (34) to a position that causes the vent closure (24) to move to the closed position and that allows the vacuum source (12) to draw vapor from the canister (14) through the vacuum port (32); and sealing-off the canister (14) by moving the purge closure (34) to a sealed position that causes the vent closure (24) to remain in the closed position and that seals off the vacuum port (32).

24. The method of claim 23 including an additional step of purging the canister (14) prior to the step of evacuating the canister (14), the purging step accomplished by moving the purge closure (34) from the shut position to a position that causes the vent closure (24) to remain in the open position and that allows the vacuum source (12) to draw vapor from the canister (14) through the vacuum port (32).

25. The method of claim 23 including the additional step of providing an actuator (36) operably connected to the purge closure (34) to move the purge closure (34) between the shut and sealed positions and to indirectly operate the vent closure (24) by controlling purge closure position.

26. A method for sealing and pressurizing a fuel vapor recovery system canister (14) to prepare the canister (14) for a positive-pressure leak check, the fuel vapor recovery system comprising a vacuum source (12) in gaseous communication with the canister (14), and a fuel tank in gaseous communication with the canister (14); the method including the steps of:

providing a combination canister vent/purge valve apparatus (10) between the vacuum source (12) and the canister (14), the apparatus (10) comprising a vent valve (16) that includes a vent chamber (18), an atmosphere vent (20) providing gaseous communication between the vent chamber (18) to the outside atmosphere, an atmosphere port (22) providing gaseous communication between the vent chamber (18) and the canister (14), and a vent closure (24) mounted in the vent chamber (18) and movable between a closed position preventing gases from flowing between the outside atmosphere and the canister (14) and a fully open position allowing gases to flow between the outside atmosphere and the canister (14), a purge valve (26) including a purge chamber (28), a vapor port (30) providing gaseous communication between the purge chamber (28) and the canister (14), a vacuum port (32) providing gaseous communication between the purge chamber (28) and the vacuum source (12), and a purge closure (34) movably mounted in the purge chamber (28) and movable from a shut position in which the purge closure (34) prevents gasses and vapor from flowing between the canister (14) and the vacuum source (12); the purge closure (34) being operably connectable to the vent closure (24);

sealing-off the canister (14) by moving the purge closure (34) to a sealed position that causes the vent closure (24) to remain in the closed position and that seals off the vacuum port (32); and providing pressurized gas within the canister (14).

* * * * *